US007966852B1

(12) United States Patent
Huang

(10) Patent No.: US 7,966,852 B1
(45) Date of Patent: Jun. 28, 2011

(54) TWO-STAGE LOCK CYLINDER STRUCTURE

(76) Inventor: Ya-Fei Huang, Rende Township, Tainan County (TW)

( * ) Notice: Subject to any disclaimer, the term of this patent is extended or adjusted under 35 U.S.C. 154(b) by 0 days.

(21) Appl. No.: 12/656,253

(22) Filed: Mar. 15, 2010

(51) Int. Cl.
*E05B 17/04* (2006.01)

(52) U.S. Cl. ..... 70/379 R; 70/369; 70/493; 70/422

(58) Field of Classification Search ..... 70/379 R, 70/380, 422, 367–371, 492, 493, DIG. 63
See application file for complete search history.

(56) References Cited

U.S. PATENT DOCUMENTS 1,137,803 A * 5/1915 Sparks ..... 70/340
1,505,865 A * 8/1924 Costa ..... 70/120
1,639,535 A * 8/1927 Russo ..... 70/379 R
2,206,462 A * 7/1940 Jacobi ..... 70/490
3,123,995 A * 3/1964 Russell et al. ..... 70/477
3,541,820 A * 11/1970 Best ..... 70/369

* cited by examiner

*Primary Examiner* — Suzanne D Barrett

(57) ABSTRACT

The present invention relates to a two-stage lock cylinder structure, which includes a lock casing, a lock barrel and an actuating unit, wherein a first joining member is located at one end of the lock barrel, and the actuating unit is fitted with a corresponding second joining member. Moreover, a flexible member is located between the lock barrel and the actuating unit, and the displacement distance of the first joining member towards the second joining member is smaller than the center distance of any of two through holes of the lock casing. Accordingly, the flexible member and the actuating unit are used to enable achieving two-stage actuation as an unlocking operation for a locking device, thereby providing the present invention with burglar-proof effectiveness.

7 Claims, 6 Drawing Sheets

TWO-STAGE LOCK CYLINDER STRUCTURE

BACKGROUND OF THE INVENTION (a) Field of the Invention

The present invention relates to a two-stage lock cylinder structure, and more particularly to a two-stage lock cylinder which uses a first joining member of a lock barrel to clamp with a second joining member of an actuating unit to enable achieving two-stage actuation as an unlocking operation for a locking device.

(b) Description of the Prior Art

Referring to FIG. 5, which shows a general lock cylinder comprising a lock casing (B), a lock barrel (C) and a key (D) (as shown in FIG. 6), wherein:

The lock casing (B) is provided with a holding hole (B1), and the lock casing (B) is further defined with a plurality of through holes (B2) that extend from the outer wall surface to the holding hole (B1), and a locking pin set (B3) is further fitted into each of the through holes (B3). Each of the locking pin sets (B3) comprises a locking piece (B31), a spring (B32), an upper locking pin (B33) and a lower locking pin (B34), length of each of the lower locking pins (B34) being different.

The lock barrel (C) is installed in the holding hole (B1) of the lock casing (B), and the lock barrel (C) is provided with a slot (C1) and a plurality of punched holes (C2) corresponding to the number of through holes (B2) of the lock casing (B). The punched holes (C2) extend from the outer wall surface to the slot (C1), and the punched holes (C2) of the lock barrel (C) intercommunicate with the through holes (B2) of the lock casing (B). The punched holes (C2) also enable the locking pin sets (B3) to penetrate therethrough.

Referring to FIG. 5, the lock barrel (C) is rotatably installed in the holding hole (B1) of the lock casing (B), and before the key (D) (as shown in FIG. 6) has been inserted into the slot (C1) of the lock barrel (C), the upper locking pins (B33) of the locking pin sets (B3) are positioned between the junction surface of the lock casing (B) and the lock barrel (C), thereby preventing the lock barrel (C) from rotating and causing the configuration to assume a locked state.

Referring to FIG. 6, after the key (D) has been inserted into the slot (C1) of the lock barrel (C), then notches (D1) of varying depth in the key (D) abut against the lower locking pins (B34) of the locking pin sets (B3) causing the lower locking pins (B34) to upwardly displace the upper locking pins (B33), thereby actuating the springs (B32) and causing the joining positions between the lower locking pins (B34) and the upper locking pins (B33) to assume a straight line corresponding to the junction surface between the lock casing (B) and the lock barrel (C), at which time, rotating the key (D) rotates the lock barrel (C), thereby unlocking the lock.

Shortcomings of the aforementioned prior art include: the locking pin sets (B3) of the lock casing (B) are easily damaged by external forces, and once a burglar extends a thin rod-shaped tool into the slot (C1) of the lock barrel (C), with the intention to effect the internal locking pin sets (B3) and move the lower locking pins (B34) and the upper locking pins (B33) of the locking pin sets (B3) to cause displacement thereof, and thereby cause the joining positions between the lower locking pins (B34) and the upper locking pins (B33) to assume a straight line corresponding to the junction surface between the lock casing (B) and the lock barrel (C), then the lock barrel (C) can be easily rotated to unlock the locking device; or means such as shaking, knocking, and so on, can be used to cause the upper locking pins (B33) to spring upwardly, and thereby cause the lock barrel (C) to rotate and unlock. Accordingly, using only the locking pin sets (B3) is insufficient to effectively secure the lock barrel (C), resulting in inferior burglar-proof ability of the locking device.

SUMMARY OF THE INVENTION

In light of the aforementioned shortcomings of a one-stage unlocking lock cylinder of the prior art, the present invention provides a two-stage lock cylinder structure, comprising a lock casing, a lock barrel and an actuating unit, wherein the lock casing is provided with a holding hole, and is further defined with a plurality of through holes that extend from the outer wall surface of the lock casing towards the holding hole. Furthermore, locking pin sets are respectively fitted in the through holes, and each of the locking pin sets comprises a locking piece, a spring, an upper locking pin and a lower locking pin, with the length of each of the lower locking pins being different. The lock barrel is installed in one end of the holding hole of the lock casing, a slot is defined in one end of the lock barrel, and a first joining member is located at the other end. Moreover, the lock barrel is additionally provided with punched holes corresponding to the through holes of the lock casing, and the punched holes penetrate the outer wall surface of the lock barrel and enter the slot. Moreover, the punched holes enable the locking pin sets to penetrate therethrough. The actuating unit is installed in another end of the holding hole, and is fixed to the lock casing using a fixing member. Moreover, a second joining member is located at one end of the actuating unit corresponding to the first joining member, a flexible member is located between the first joining member and the second joining member, and the two ends of the flexible member are respectively fitted with a filling piece. Pin connecting portions are located at another end of the actuating unit, and a fixed locking member is pin connected to the actuating unit using a pin connecting member. In addition, the displacement distance of the first joining member towards the second joining member is smaller than the center distance of any two of the through holes of the lock casing.

A key is inserted into the aforementioned slot, and notches are defined on the key matching the locking pin sets.

The aforementioned punched holes are perpendicular to the opening of the slot and penetrate the outer wall surface of the lock barrel to enter the slot.

The first joining member of the aforementioned lock barrel is fitted with an insertion piece, and the second joining member of the actuating unit is defined with a corresponding insertion groove.

The first joining member of the aforementioned lock barrel is defined with an insertion groove, and the second joining member of the actuating unit is fitted with a corresponding insertion piece.

The aforementioned fixing member is defined with a fixing hole, and the pin connecting portions are mounted in the fixing hole; the fixing member is also screw locked to the lock casing using screws.

The aforementioned flexible member is a spring.

Effectiveness of the present invention lies in: Even if a burglar extends a thin rod-shaped tool into the slot of the lock barrel, with the intention to effect the internal locking pin sets or uses means such as shaking, knocking, and the like, to cause the upper locking pins to spring upwardly, and thereby cause the lock barrel to rotate and unlock, however, because the first joining member of the lock barrel and the second joining member of the actuating unit have not yet joined together, thus, the lock barrel can only rotate idlely and is unable to drive the actuation unit, and effects no unlocking function, thereby achieving burglar-proof effectiveness.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
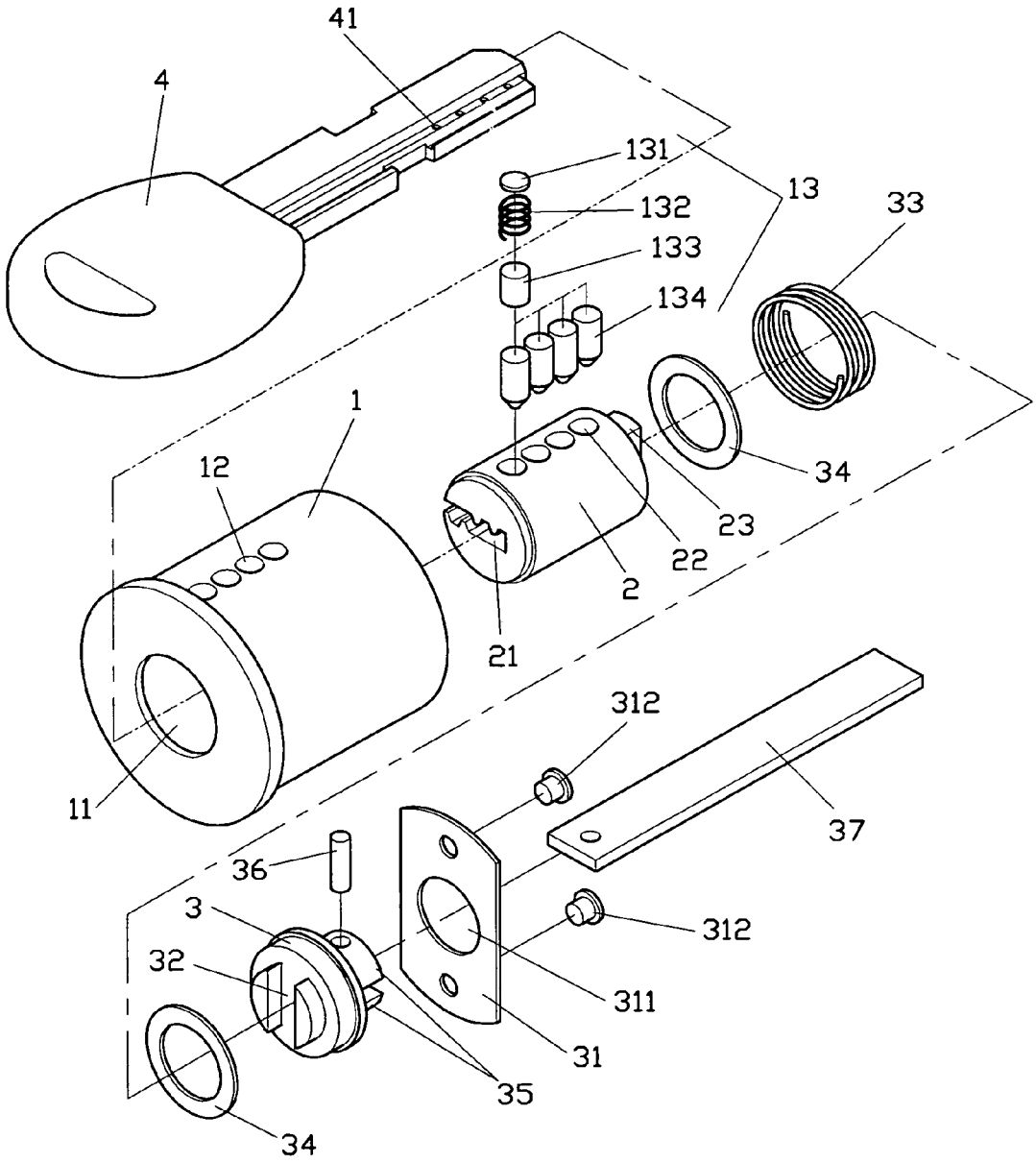
FIG. 1 is an exploded view of the present invention together with a key.
Figure 2:
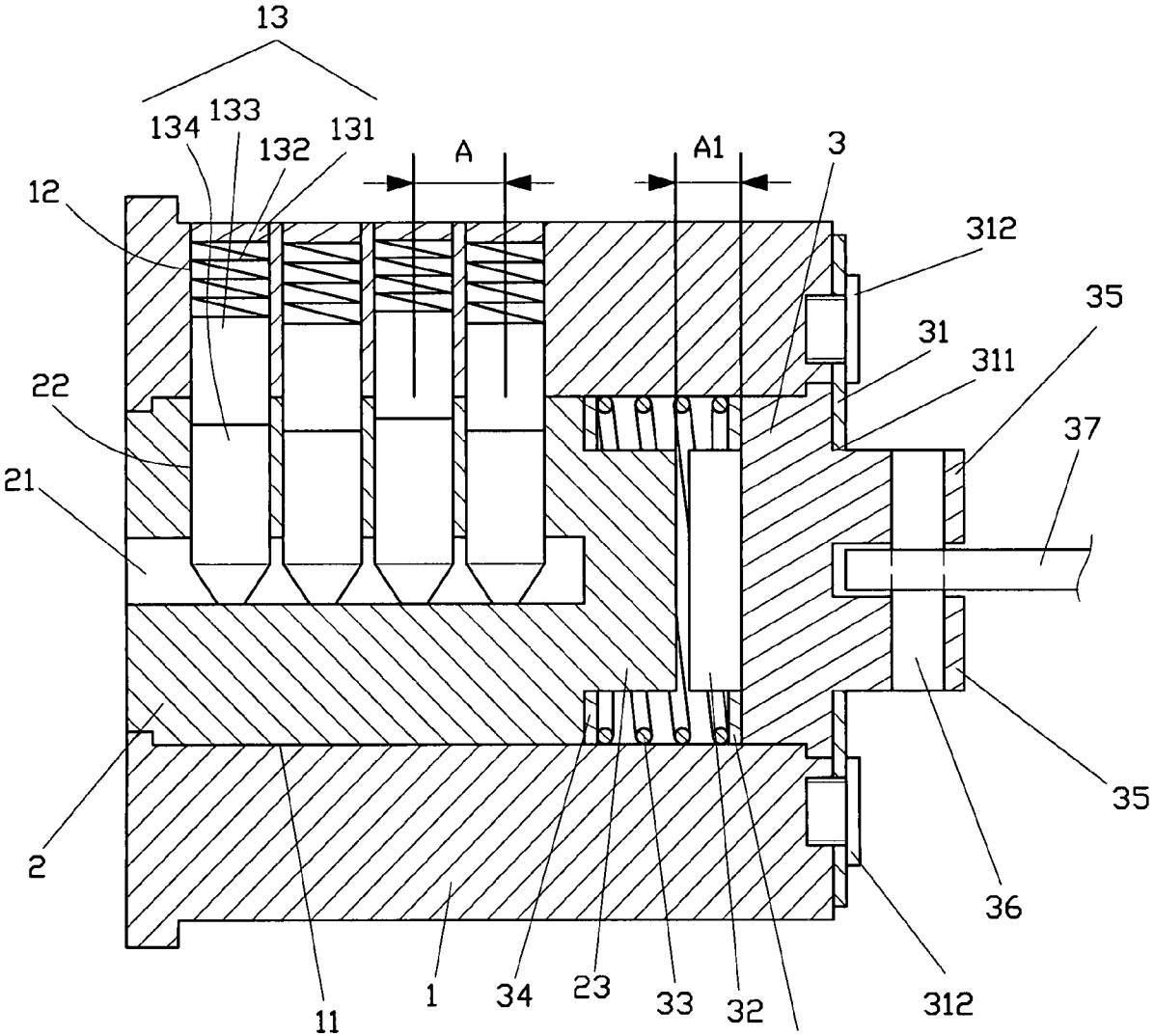
FIG. 2 is cutaway view of the present invention.

Referring first to FIG. 1 and FIG. 2, which show a two-stage lock cylinder structure of the present invention, comprising a lock casing (1), a lock barrel (2) and an actuating unit (3), wherein:

The lock casing (1) is provided with a holding hole (11), and the lock casing (1) is further defined with a plurality of through holes (12) that extend from the outer wall surface to the holding hole (11). Furthermore, locking pin sets (13) are respectively fitted in the through holes (12), and each of the locking pin sets (13) comprises a locking piece (131), a spring (132), an upper locking pin (133) and a lower locking pin (134), with the length of each of the lower locking pins (134) being different.

The lock barrel (2) is installed in one end of the holding hole (11) of the lock casing (1), a slot (21) is defined in one end of the lock barrel (2), and a first joining member (23) is located at the other end. Moreover, the lock barrel (2) is additionally provided with punched holes (22) corresponding to the through holes (12) of the lock casing (1), and the punched holes (22) penetrate the outer wall surface of the lock barrel (2) and extend into the slot (21). The punched holes (22) of the present embodiment are perpendicular to the opening of the slot (21) and penetrate the outer wall surface of the lock barrel (2) to extend into the slot (21). Moreover, the punched holes (22) also enable the locking pin sets (13) to penetrate therethrough.

The actuating unit (3) is installed in the other end of the holding hole (11), and is fixed to the lock casing (1) using a fixing member (31). Moreover, a second joining member (32) is located at one end of the actuating unit (3) to correspond with the first joining member (23). A flexible member (33) is located between the first joining member (23) and the second joining member (32), and the two ends of the flexible member (33) are respectively fitted with a filling piece (34). Pin connecting portions (35) are located at another end of the actuating unit (3), and a fixed locking member (37) is pin connected to the actuating unit (3) using a pin connecting member (36). In addition, displacement distance (A1) of the first joining member (23) towards the second joining member (32) is smaller than the center distance of any two of the through holes (12) of the lock casing (1). The fixing member (31) of the present embodiment is provided with a fixing hole (311), and the pin connecting portions (35) penetrate and extend into the fixing hole (311). The fixing member (31) is locked onto the lock casing (1) using screws (312).

A key (4) is inserted into the slot (21) of the present embodiment, and notches (41) are defined on the key (4) to match the locking pin sets (13).

Referring to FIG. 1, an insertion piece is located on the first joining member (23) of the lock barrel (2), and a corresponding insertion groove is defined in the second joining member (32) of the actuating unit (3), thereby enabling mutual clamping between the lock barrel (2) and the actuating unit (3), or, an insertion groove is defined in the first joining member (23) of the lock barrel (2), and a corresponding insertion piece (not shown in the drawing) is located on the second joining member (32) of the actuating unit (3).

Referring to FIG. 2, the lock barrel (2) is rotatably installed in the holding hole (11) of the lock casing (1), and before the key (4) has been inserted into the slot (21) of the lock barrel (2), the upper locking pins (133) of the locking pin sets (13) are positioned at the junction interface of the lock casing (1) and the lock barrel (2), thereby preventing the lock barrel (2) from rotating and causing the lock cylinder to assume a locked state.

Figure 3:
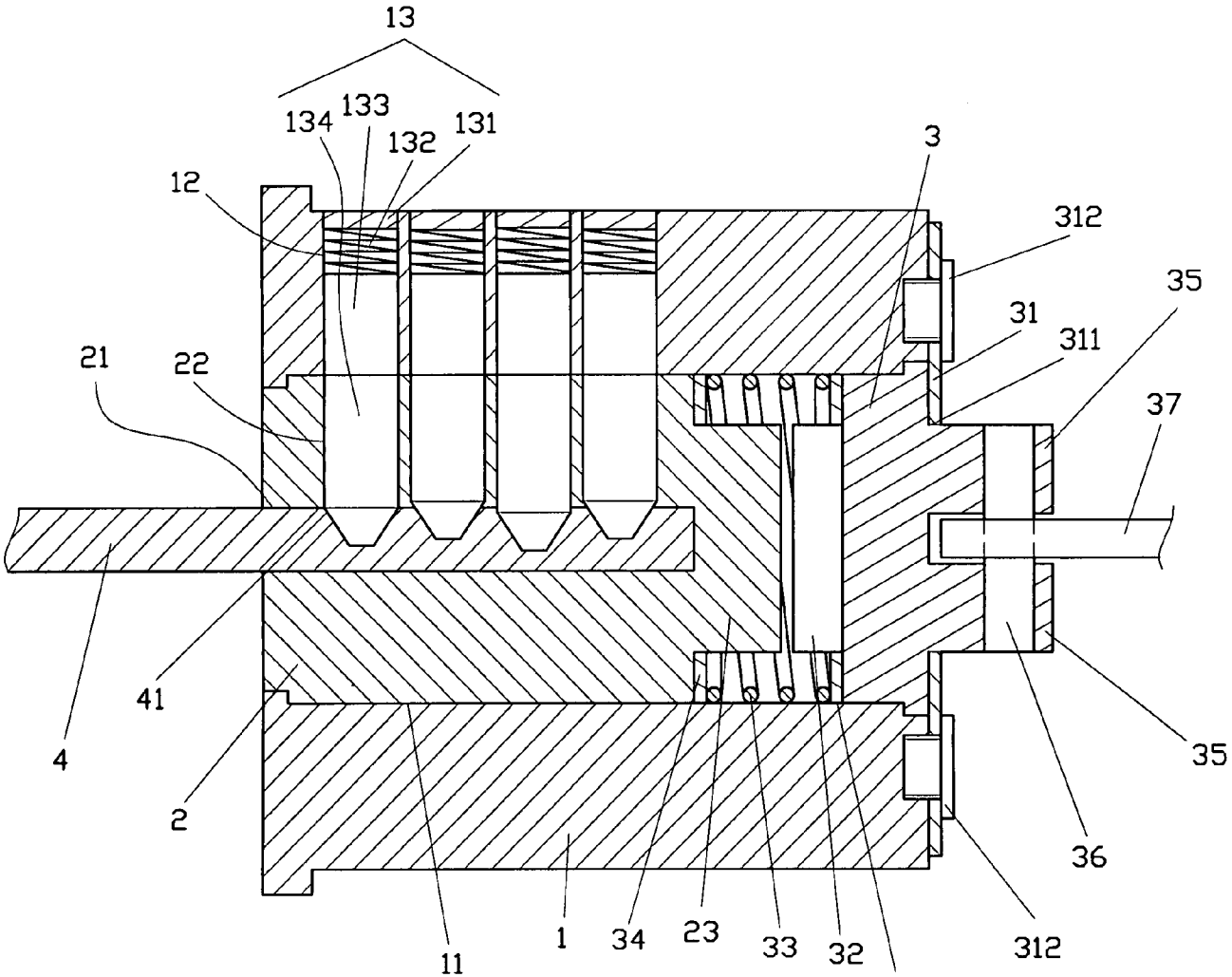
FIG. 3 is an operational schematic view 1 of the present invention together with a key.

Referring to FIG. 3, after the key (4) has been inserted into the slot (21) of the lock barrel (2), the varying depths of the notches (41) on the key (4) push against the lower locking pins (134) of the locking pin sets (13) causing the lower locking pins (134) to upwardly push the upper locking pins (133), thereby compressing the springs (132) and causing the joining positions of the lower locking pins (134) and the upper locking pins (133) to assume a straight line, which further corresponds to the junction interface of the lock casing (1) and the lock barrel (2).

Figure 4:
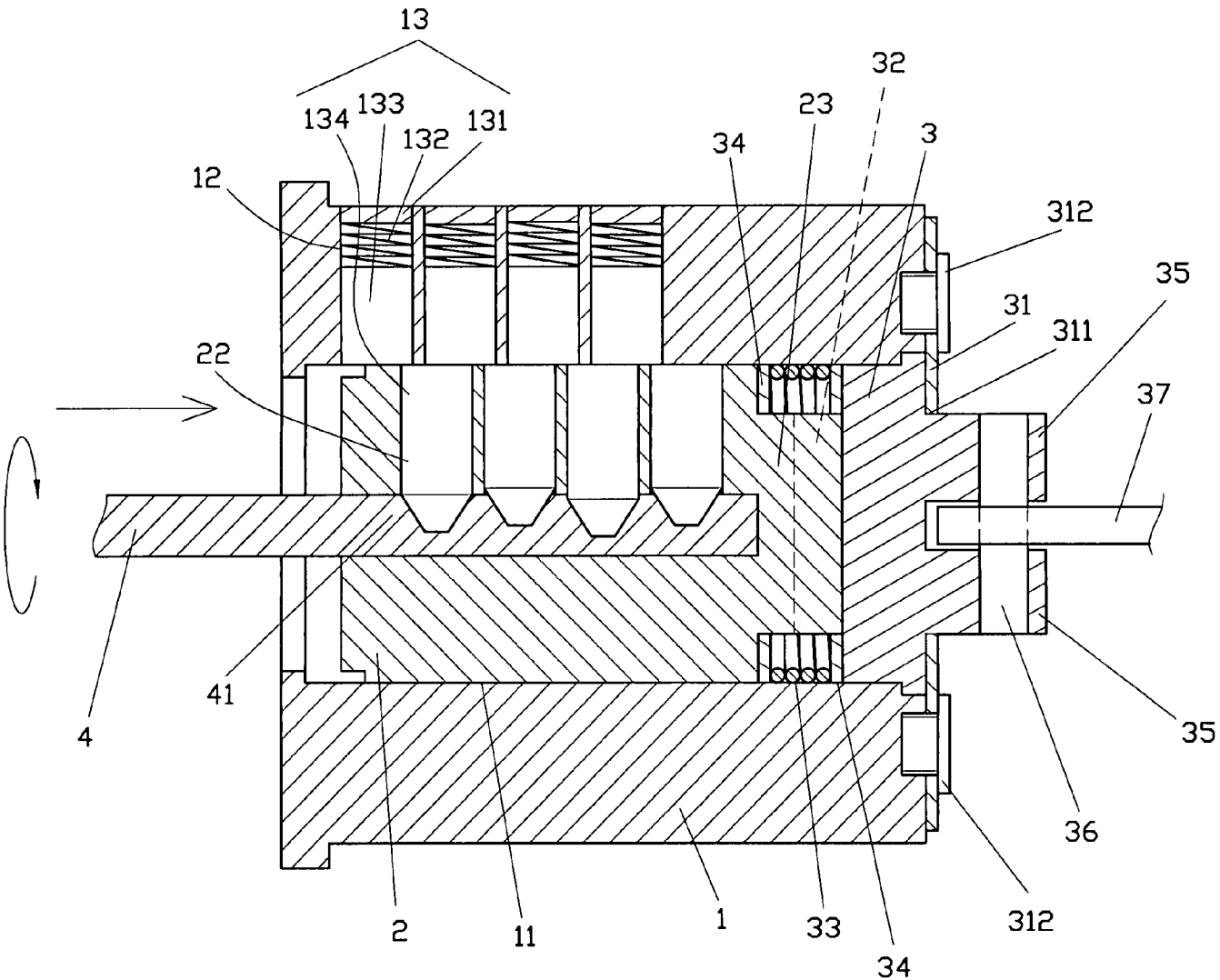
FIG. 4 is an operational schematic view 2 of the present invention together with a key.
Figure 5:
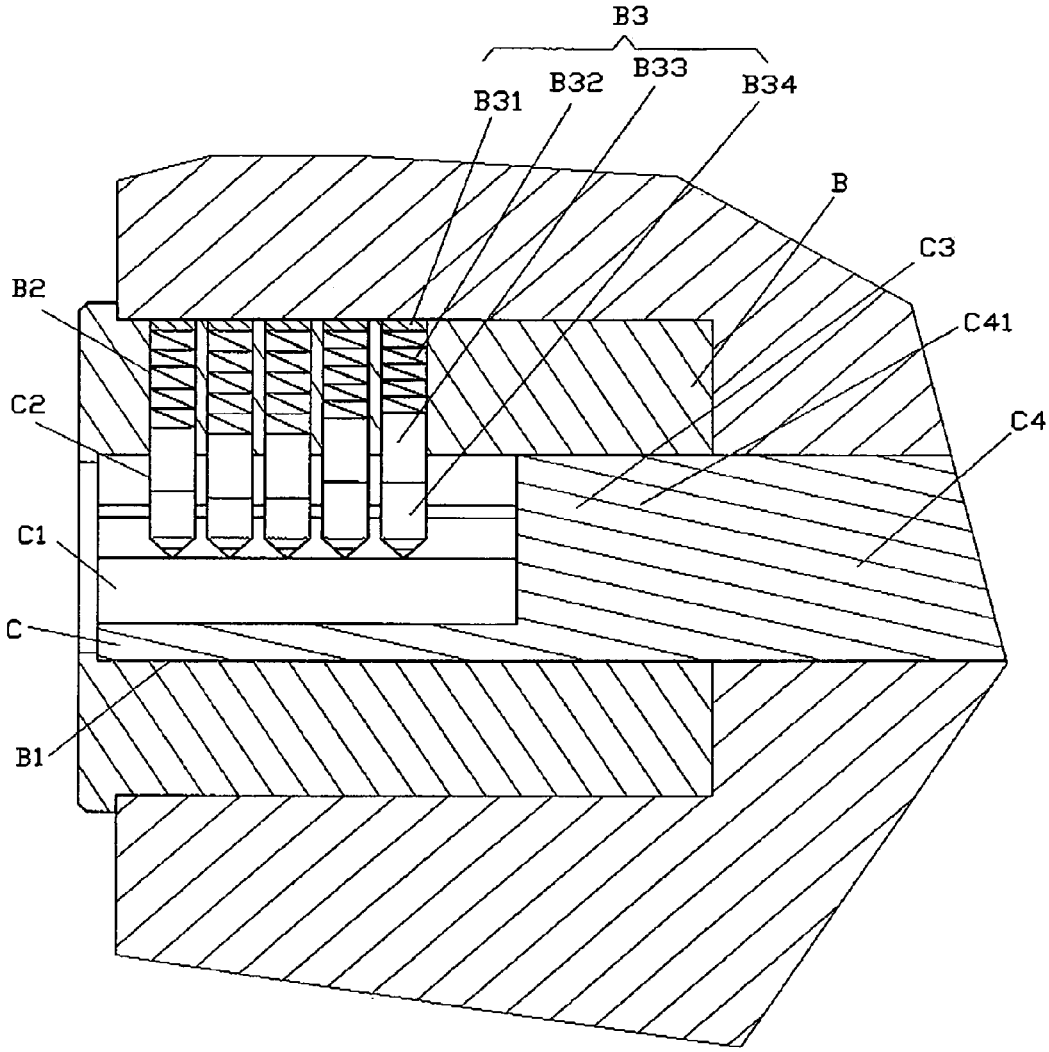
FIG. 5 Prior Art
FIG. 5 is a cutaway view of a lock cylinder of the prior art.
Figure 6:
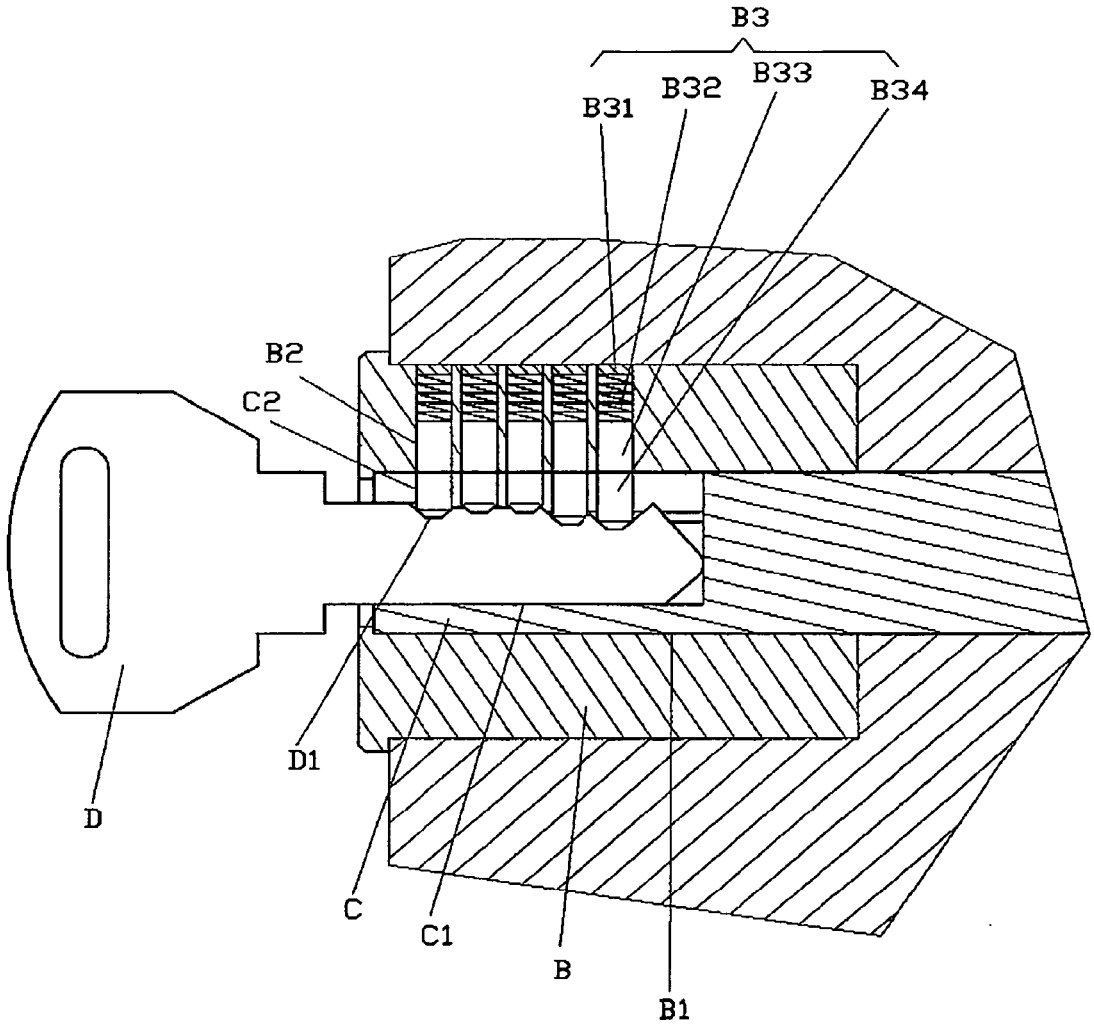
FIG. 6 Prior Art
FIG. 6 is an operational schematic view of the lock cylinder together with a key of the prior art.

Referring to FIG. 4, when the joining positions of the lower locking pins (134) and the upper locking pins (133) assume a straight line, then the lock barrel (2) must be pressed again to cause the lock barrel (2) to move toward the direction of the actuating unit (3), whereupon the entire row of the lower locking pins (134) are made to move along with the lock barrel (2).

The distance moved by the lock barrel (2) is displacement distance (A1) depicted in FIG. 2, and because the displacement distance (A1) is smaller than the center distance (A) between two of the through holes (12), thus, the lower locking pins (134) are still able to effectively support the upper locking pins (133) while holding the spring (132), and enables the joining positions of the lower locking pins (134) and the upper locking pins (133) to still assume a straight line. Accordingly, rotating action of the lock barrel (2) is not affected. The flexible member (33) is compressed when the lock barrel (2) is displaced, thereby causing the first joining member (23) of the lock barrel (2) to clamp with the second joining member (32) of the actuating unit (3), at which time, rotating the lock barrel (2) simultaneously causes the actuating unit (3) to rotate, which drives and rotates the fixed locking member (37), thereby unlocking the locking device. Moreover, the filling pieces (34) located at the two ends of the flexible member (33) prevent jamming of the first joining member (23) or the second joining member (32) at the two ends of the flexible member (33) due to the rotating action when the lock barrel (2) and the actuating unit (3) are rotating along with rotation of the key (4), which would otherwise make it difficult to unlock and easily damaging the flexible member (33). Furthermore, the pin connecting portions (35) extend through the fixing hole (311) of the fixing member (31), and the fixing member (31) is fixedly locked to the lock casing (1) using screws (312). Such a fixing means enables the actuating unit (3) to be very easily assembled to the lock casing (1).

When locking, the lock barrel (2) turns the lower locking pins (134) and the upper locking pins (133) of the locking pin sets (13) back to a coinciding state, and repositioning of the flexible member (33) is used to return the lock barrel (2) back to realignment of the lower locking pins (134) and the upper locking pins (133) of the locking pin sets (13), at which time the grip of the locking pin sets (13) on the key (4) is released, which enables the key (4) to be extracted, thereby causing the lock cylinder to assume a locked state.

In the state depicted in FIG. 3, although the lock barrel (2) can be rotated, because the first joining member (23) of the lock barrel (2) and the second joining member (32) of the actuating unit (3) are not yet clamped together, thus, even if the lock barrel (2) is rotated, it only results in idle rotation thereof. Hence, even if the lock barrel (2) is damaged, the actuating unit (3) can still not be driven, thereby enabling the present invention to serve as a two-stage operation burglar-proof lock cylinder.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A two-stage lock cylinder structure, comprising:

a lock casing, the lock casing is provided with a holding hole, and the lock casing is defined with a plurality of through holes that extend from the outer wall surface to the holding hole, locking pin sets are further fitted in the through holes, and each of the locking pin sets comprises a locking piece, a spring, an upper locking pin and a lower locking pin, with the length of each of the lower locking pins being different;

a lock barrel, the lock barrel is installed in one end of the holding hole of the lock casing, a slot is defined in one end of the lock barrel, and the lock barrel is additionally provided with punched holes corresponding to the through holes of the lock casing, and the punched holes penetrate the outer wall surface of the lock barrel and extend into the slot, the punched holes also enable the locking pin sets to penetrate therethrough;

the other end of the lock barrel is fitted with a first joining member, and additionally installed with an actuating unit, the actuating unit is installed in the other end of the holding hole, and is fixed to the lock casing using a fixing member, moreover, a second joining member is located at one end of the actuating unit to correspond with the first joining member, a flexible member is located between the first joining member and the second joining member, and the two ends of the flexible member are respectively fitted with a filling piece, pin connecting portions are located at another end of the actuating unit, and a fixed locking member is pin connected to the actuating unit using a pin connecting member, in addition, displacement distance of the first joining member towards the second joining member is smaller than the center distance of any two of the through holes of the lock casing.

2. The two-stage lock cylinder structure according to claim 1, wherein a key is inserted into the slot, and notches are defined on the key to match the locking pin sets.

3. The two-stage lock cylinder structure according to claim 1, wherein the punched holes are perpendicular to the opening of the slot and penetrate the outer wall surface of the lock barrel and extend into the slot.

4. The two-stage lock cylinder structure according to claim 1, wherein an insertion piece is located on the first joining member of the lock barrel, and a corresponding insertion groove is defined in the second joining member of the actuating unit.

5. The two-stage lock cylinder structure according to claim 1, wherein an insertion groove is defined in the first joining member of the lock barrel, and a corresponding insertion piece is located on the second joining member of the actuating unit.

6. The two-stage lock cylinder structure according to claim 1, wherein the fixing member is provided with a fixing hole, and the pin connecting portions are mounted in the fixing hole, the fixing member is locked onto the lock casing using screws.

7. The two-stage lock cylinder structure according to claim 1, wherein the flexible member is a spring.

* * * * *